United States Patent [19]

Den Besten

[11] Patent Number: 5,018,793

[45] Date of Patent: May 28, 1991

[54] ROTATIONALLY AND AXIALLY MOVABLE BIT

[76] Inventor: Leroy E. Den Besten, Rd. #2, Castleton, N.Y. 12033-9648

[21] Appl. No.: 480,365

[22] Filed: Feb. 13, 1990

Related U.S. Application Data

[63] Continuation of Ser. No. 273,049, Nov. 18, 1988, abandoned.

[51] Int. Cl.[5] ..... E21C 25/46; E21C 35/18

[52] U.S. Cl. ..... 299/86; 299/92

[56] References Cited

U.S. PATENT DOCUMENTS

| | | | |
|---|---|---|---|
| 3,820,848 | 6/1974 | Kniff | 299/92 X |
| 4,149,753 | 4/1979 | Stoltz et al. | 299/86 X |
| 4,755,003 | 7/1988 | Pinkerton et al. | 299/86 |

FOREIGN PATENT DOCUMENTS

| | | | |
|---|---|---|---|
| 3630444 | 3/1988 | Fed. Rep. of Germany | 299/92 |
| 608923 | 5/1978 | U.S.S.R. | 299/86 |
| 1086153 | 4/1984 | U.S.S.R. | 299/92 |

*Primary Examiner*—Bruce M. Kisliuk
*Assistant Examiner*—David J. Bagnell
*Attorney, Agent, or Firm*—Kane, Dalsimer, Sullivan, Kurucz, Levy, Eisele and Richard

[57] ABSTRACT

The present invention relates to an improved cutting bit adapted to be rotationally and axially movable within the block cutting bit assembly. The invention further includes a spring for dampening the axially transmitted forces which the bit is subjected to during cutting operations. In an alternative embodiment, a retainer cap having a pin engages a lug on the shank of the cutting bit so as to bias the bit during cutting operations.

14 Claims, 2 Drawing Sheets

FIG. 1
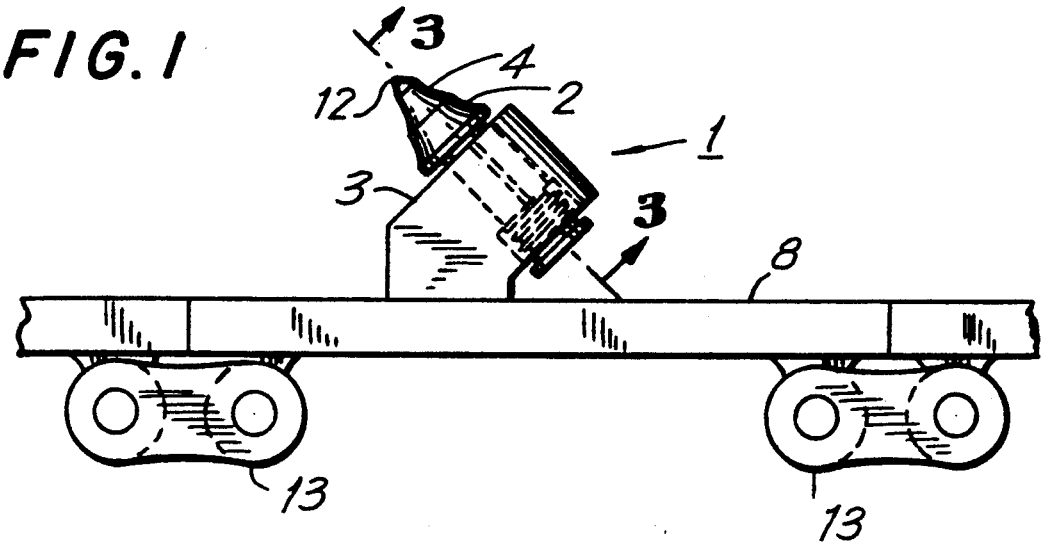
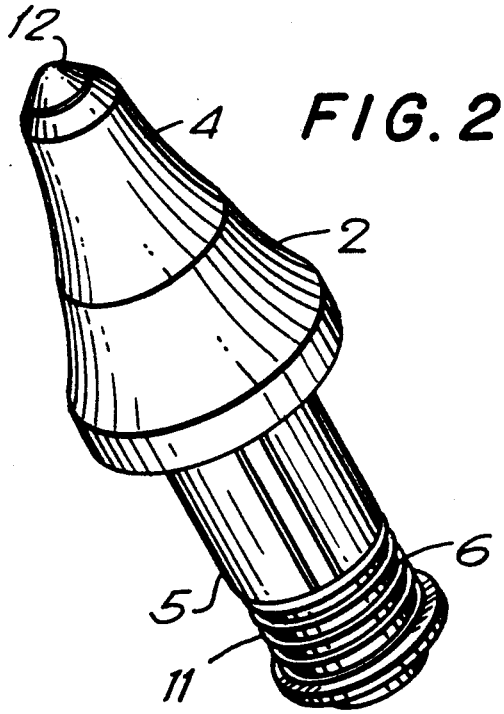
FIG. 2
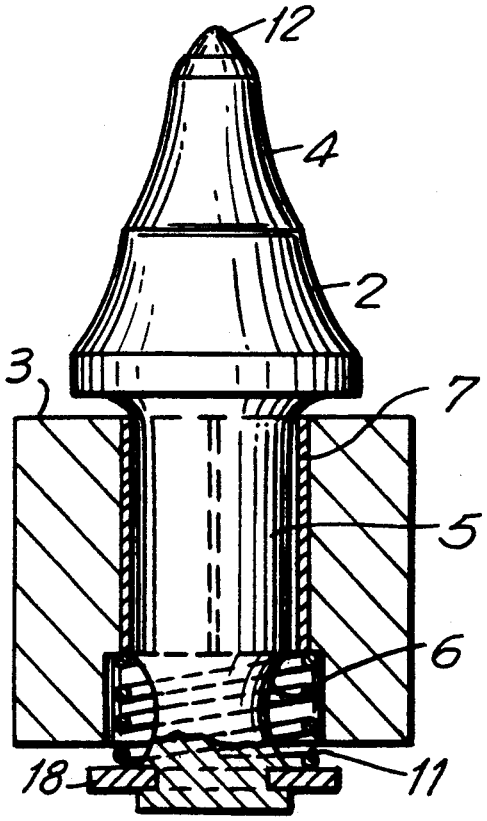
FIG. 3

FIG. 4
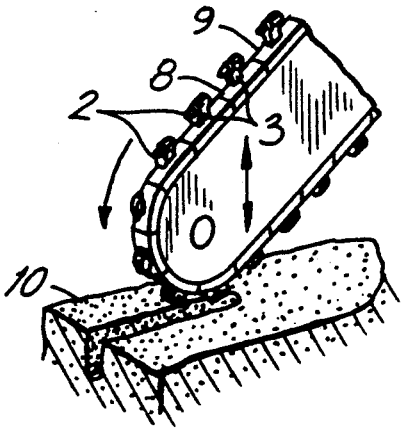
FIG. 5
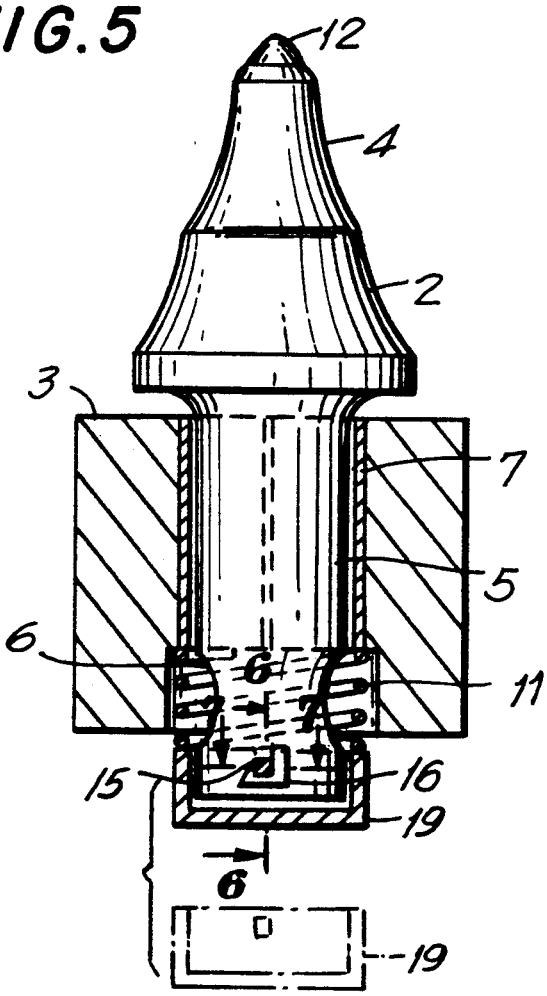
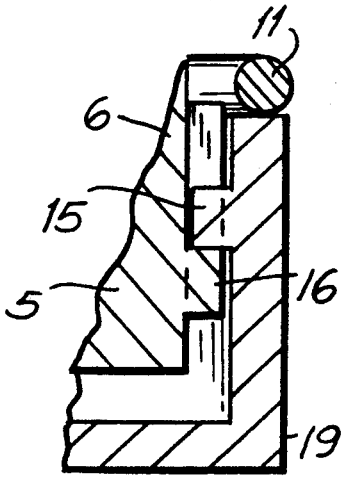
FIG. 6
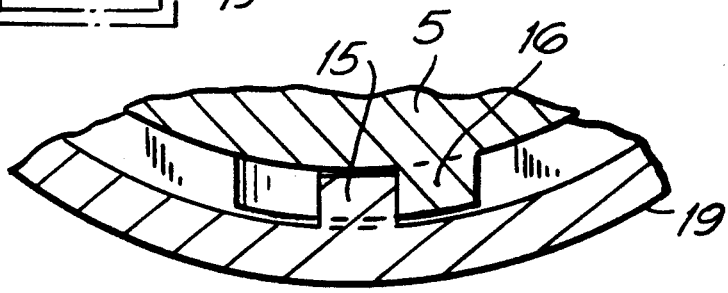
FIG. 7

ROTATIONALLY AND AXIALLY MOVABLE BIT

This is a continuation of co-pending application Ser. No. 273,049 filed on Nov. 18, 1988, now abandoned.

FIELD OF THE INVENTION

The present invention relates to cutter bit devices and to a cutter bit device for use in excavating operations such as in trenching, concrete cutting, road scarifying, mining, or the like. The invention relates more particularly to a cutter bit which is mounted for a generally free rotational and axial movement within a mounting block including a mounting block having a retainer sleeve in which the bit is received and a resilient element adapted to dampen the axial forces exerted on the bit to prevent axial dislodgement of the cutter bit member during use thereof.

BACKGROUND OF THE INVENTION

Various types of cutter bit devices have been provided in the prior art for use in construction and mining. A particularly successful bit is disclosed in U.S. Pat. No. 4,2012,421 to Den Besten. In certain applications, such devices are subject to axial forces which can cause a bit to disengage from the block it is housed within. Various prior art proposals have utilized keepers, to retain the bit within the sleeve during cutting operations. U.S. Pat. No. 4,462,638 to Den Besten, applicant of the subject patent application, discloses a keeper 26 which passes through vertical slot 24 in the stem 16 of the bit 10 in order to retain the bit in the sleeve. However, the problems with such prior art proposals is that during the operation, particularly at high RPM, such keepers on occasion would fail, disengage or disintegrate.

It is therefore desirable and beneficial for a bit to be able to axially move within the sleeve during operations while being retained therein.

SUMMARY OF THE INVENTION

Accordingly it is a principal object of the invention to avoid the drawbacks of the aforementioned prior art proposals by providing means for absorbing axial forces to the bit.

It is still another object of the invention to provide means for permitting generally free rotation of the bit.

In order to implement these and other objects of the invention, which will become more readily apparent as the description proceeds, the present invention provides spring means for absorbing the axial forces along a bit or to cushion a bit.

BRIEF DESCRIPTION OF DRAWINGS

For fuller understanding of the nature and the objects of the invention, reference should be had to the following detailed description, taken in connection with the accompanying drawings, in which;

FIG. 1 is a side of elevational view of one bit connected in its housing in its assembly;

FIG. 2 is a prospective view of an individual bit;

FIG. 3 is a sectional view along the lines 3—3 of FIG. 1;

FIG. 4 is a partial prospective view of a bit in cutting engagement with the surface;

FIG. 5 is a sectional view similar to FIG. 3 of an alternative embodiment;

FIG. 6 is a sectional view of along the lines 6—6 of FIG. 5; and FIG. 7 is a sectional view the along lines 7—7 of FIG. 5.

DETAILED DESCRIPTION OF THE PREFERRED EMBODIMENTS

Referring now to the drawings in particular to FIG. 1, a cutter device 1 of the present invention is shown. The cutter device 1 includes a cutting bit 2 and an attachable mounting and mounting block 3. As shown the cutter bit 2 has a generally conically shaped nose portion 4 and a shank portion 5 having a grooved section 6 which is adapted to receive a spring 11 thereon as shown in FIG. 3.

The conical nose portion 4 of the bit 2 is usually of a diameter which is greater than that of the shank 5, precluding the possibility of it being forced into the mount 3. Contained in the tip of the nose 4 is a pointed insert 20. This insert 20 is preferably made of a carbide metal, but may be made of any other material suitable for that purpose. The stem of the bit is that portion of which is inserted in the mount 3.

The shank portion 5 of the cutting bit member 2 is of a cylindrical shape and housed in a split wear sleeve 7. The sleeve 7 is split and is a wear and retaining means by which it is secured to the mounting block 3 and serves to accept wear and to retain the bit 2 in the block 3. The mounting block 3 is in turn secured to a plate 8 of the cutting device 1. thus securing the cutting bit 2 to a plate 8 of the cutting bit device 1. Thus the cutting bit 2 with the sleeve 7 are first mounted in the mounting block 3 and then the spring 11 and a retaining clip 18 (FIG. 3) or alternatively a retaining cap 19 (FIG. 5) is applied.

The plate 8 is secured to a trench chain 9 as shown in FIG. 4. FIG. 4 shows a plurality of such plate assemblies which rotate on the trench chain 9 so that there is always a bit in cutting engagement with the cutting surface during the rotational operation of the trench chain 9.

As shown in FIG. 2, the grooved section 6 of the shank portion 5 is adapted to receive a spring member 11 thereon. The purpose of the spring 11 is to act as a dampening element so that when the cutting bit 2 is in cutting engagement with a surface during operation, as shown in FIG. 4, the axial forces transmitted to the cutting bit 2 will be dampened by the spring member 11. In addition, the cutting bit 2 is freely rotatable within the sleeve 7. The sleeve 7 acts as a buffer between the bit 2 and the mounting block 3 absorbing any wear that might result on the bit 2 by rotation of the bit 2 or any interaction between the bit 2 and the mount.

Since the bit 2 is loosely embraced by the sleeve 7, the bit 2 is allowed to rotate, providing for even wear upon its surface thereby prolonging its useful life. By rotating the cutting bit 2, the tip portion 12 of the cutting bit 2 remains sharp and the excavated ground material flows through the assembly very easily, between the cutting bit 2 and the mounting block 3 and around the spring 11.

The plate 8 is welded to a set of fasteners 13 which secure the plate 8 to the trench chain 9 as shown in FIG. 4.

FIG. 5 shows an alternative embodiment of the invention in which instead of a retainer clip 18 (FIG. 3), a retainer cap 19 is secured to the back side of the cutting bit 2. To retain the cap 19, a pin 15 is fastened to a lug 16 within the shank portion 5 of the cutting bit 2 as shown in FIGS. 5,6 and 7. The retainer cap 19 biases the spring 11 so that the cutting bit 2 is in cutting engagement with the surface to be excavated.

I do not limit myself to any particular detail of construction set forth in the specification and illustrated accompanying drawings as the same refers and sets forth only certain embodiments of the invention, it is observed that the some might be modified without departing from the spirit and scope of the invention.

Having thus described the invention, what I claim as new and desired to be secured by Letters Patent is as follows:

I claim:

1. A cutting bit for mounting in a block, comprising a generally conically shaped nose portion and a shank, said shank having a grooved section, a coil spring engagingly mounted on said grooved section of said shank, a sleeve surrounding said shank for retaining the bit in the block wherein said spring dampens axial forces which said bit is subjected to during cutting operations and which cause said bit to be expelled from the block.

2. A cutting bit according to claim 1 wherein said spring is retained by a retaining cap located on the base of said shank thereby acting on said spring and biasing said cutting bit into cutting engagement during cutting operations.

3. A cutting bit for mounting in a block, comprising a generally conically shaped nose portion and a shank, said shank having a grooved section, a spring engagingly mounted on said grooved section of said shank, a sleeve surrounding said shank for retaining the bit in the block wherein said spring dampens axial forces to which said bit is subjected during cutting operations and which cause said bit to be expelled from the block, wherein said spring is retained by a retaining cap located on the base of said shank thereby acting on said spring and biasing said cutting bit into cutting engagement during cutting operations; and further comprising a lug within said shank and a pin which fastens said retaining cap to said lug.

4. A cutting bit for mounting a block comprising a generally conically shaped nose portion and a shank, a coil spring engaging said shank, a sleeve surrounding said shank for retaining the bit in the block wherein said coil spring dampens axial forces to which said cutting bit is subjected during cutting operations and which cause said bit to be expelled from the block.

5. A cutting bit according to claim 4 wherein said shank has a grooved section and said coil spring is engagingly mounted thereon.

6. A cutting bit according to claim 4, further comprising retaining means located on said shank for retaining said cutting bit in cutting engagement during cutting operations.

7. A cutting bit according to claim 6 wherein said retaining means is a retaining cap located on said shank.

8. A cutting bit for mounting in a block comprising a generally conically shaped nose portion and a shank, resilient means engaging said shank, a sleeve surrounding said shank for retaining the bit in the block, a retaining cap located on said shank for biasing said cutting bit in cutting engagement during cutting operations, a lug within said shank and a pin which fastens said retaining cap to said lug; and wherein said resilient means dampens axial forces to which said cutting bit is subjected during cutting operations.

9. A cutting bit for mounting in a block comprising a nose portion and a shank having a nose end and a rear end, a split wear sleeve surrounding the shank for retaining the bit in the block, the shank and consequently the bit being rotatable in the sleeve and consequently the block, a coil spring for biasing the bit in a longitudinal direction in the block to thereby dampen the axial forces transmitted to the bit during operation which cause said bit to be expelled from the block so that during operation the bit is both axially and rotationally movable relative to the sleeve and in the block.

10. A bit according to claim 9 wherein said coil spring is located at the rear end of said shank.

11. A bit according to claim 9 further comprising a retaining clip disposed at the rear end of said shank for retaining said bit relative to the sleeve and the block.

12. A bit according to claim 9 further comprising a retaining cap disposed at the rear end of said shank for retaining said bit relative to the sleeve and the block.

13. A cutting bit for mounting in a block comprising a nose portion and a shank having a nose end and a rear end, a split wear sleeve surrounding the shank or retaining the bit in the block, the shank and consequently the bit being rotatable in the sleeve and consequently the block, a retaining clip disposed at the rear end of the shank for retaining said bit relative to the sleeve and the block, a spring for biasing the bit in a longitudinal direction in the block to thereby dampen the axial forces transmitted to the bit during operation which cause said bit to be expelled from said block so that during operation the bit is both axially and rotationally movable relative to the sleeve and in the block, and wherein said block has a bore at its rear end defining a shoulder and said spring is biased between the shoulder and the retaining clip.

14. A cutting bit for mounting in a block comprising a nose portion and a shank having a nose end and a rear end, a split wear sleeve surrounding the shank for retaining the bit in the block, the shank and consequently the bit being rotatable in the sleeve and consequently the block, a retaining cap disposed at the rear end of the shank for retaining said bit relative to the sleeve and the block, a spring for biasing the bit in a longitudinal direction in the block to thereby dampen the axial forces transmitted to the bit during operation which cause said bit to be expelled from said block so that during operation the bit is both axially and rotationally movable relative to the sleeve and in the block, and wherein said block has a bore at its rear end defining a shoulder and said spring is biased between the shoulder and the retaining cap.

* * * * *